US007840021B2

(12) United States Patent
Greco et al.

(10) Patent No.: US 7,840,021 B2
(45) Date of Patent: Nov. 23, 2010

(54) METHOD AND APPARATUS FOR A WEATHER PROOF NOTIFICATION DEVICE

(75) Inventors: Scott J. Greco, Higganum, CT (US); Walter R. Wrobel, New Britain, CT (US)

(73) Assignee: UTC Fire & Security Corporation, Inc., Bradenton, FL (US)

( * ) Notice: Subject to any disclaimer, the term of this patent is extended or adjusted under 35 U.S.C. 154(b) by 1145 days.

(21) Appl. No.: 11/349,163

(22) Filed: Feb. 8, 2006

(65) Prior Publication Data

US 2006/0177089 A1 Aug. 10, 2006

Related U.S. Application Data

(60) Provisional application No. 60/650,526, filed on Feb. 8, 2005.

(51) Int. Cl.
*H04R 25/00* (2006.01)

(52) U.S. Cl. ..... 381/334; 381/391; 181/175

(58) Field of Classification Search ..... 381/334–335, 381/359, 391–392, 395; 361/141, 174; 181/175, 181/199

See application file for complete search history.

(56) References Cited

U.S. PATENT DOCUMENTS

| | | | | | |
|---|---|---|---|---|---|
| 3,989,909 | A * | 11/1976 | Hodsdon et al. | ..... | 381/391 |
| 3,995,125 | A * | 11/1976 | Cypser | ..... | 381/391 |
| 4,356,881 | A * | 11/1982 | Lowell | ..... | 181/150 |
| 4,662,547 | A * | 5/1987 | Villanueva et al. | ..... | 224/418 |
| 5,551,905 | A * | 9/1996 | Billings et al. | ..... | 446/151 |
| 6,243,001 | B1 * | 6/2001 | Kodaka | ..... | 340/326 |

* cited by examiner

*Primary Examiner*—Suhan Ni
(74) *Attorney, Agent, or Firm*—Armstrong Teasdale LLP

(57) ABSTRACT

A weather-proof notification device includes an enclosure having an integrally formed grille and a speaker located within and attached to the enclosure proximate the grille. The grille is configured to inhibit the entry of rainwater into the interior of the enclosure. A water-resistant or water-tight seal is provided between the speaker and the enclosure, and the speaker includes a water-repellent diaphragm, in order to prevent water from migrating from the sound chamber into the operating electrical compartment. A drain is provided on the grille to permit free drainage of water from the sound chamber.

7 Claims, 3 Drawing Sheets

METHOD AND APPARATUS FOR A WEATHER PROOF NOTIFICATION DEVICE

CROSS-REFERENCE TO RELATED APPLICATIONS

This application claims priority to provisional U.S. patent application entitled METHOD AND APPARATUS FOR A WEATHER-PROOF GRILLED ENCLOSURE SYSTEM, filed Feb. 8, 2005, having a Ser. No. 60/650,526, the disclosure of which is hereby incorporated by reference in its entirety.

FIELD OF THE INVENTION

The present invention relates generally to commercial and industrial voice and audio systems. More particularly, the present invention relates to a weather-proof notification device.

BACKGROUND OF THE INVENTION

Commercial and industrial notification systems require the installation and use of notification devices. These devices can include, but are not limited to, speaker amplifiers, tone generators, voice output generators, and optical signaling devices such as strobe lights. Such notification devices may be used for general signaling and emergency evacuation. For example, a system of audible and visible alarm devices, including sirens and strobe lights, may be furnished as part of a fire alarm system for an office building.

In industrial applications, these devices must often be located in areas exposed to the elements, such as exterior building walls lacking substantial overhead protection. For example, it may be necessary or desirable to furnish notification devices in exterior locations of a chemical plant. Notification devices installed outdoors will be subject to environmental conditions, including precipitation. Therefore, it is possible that water will intrude into the notification device, potentially interfering with its operation or damaging its components.

Underwriters Laboratories (UL) requires that any devices suitable and listed for outdoor use must have the ability to operate when exposed to such conditions. This ability is confirmed by performing a simulated rain test for a pre-established period of time during which the device must operate without failure. The unit must not only operate, but also prevent water from entering the operating electrical compartment.

Accordingly, it is desirable to provide a notification device that inhibits the intrusion of rain into the operating electrical compartment of the device while permitting the free passage of sound from the device into surrounding environs.

SUMMARY OF THE INVENTION

The foregoing needs are met, to a great extent, by the present invention, wherein in one aspect an apparatus is provided that in some embodiments provides a weather-proof notification device capable of inhibiting the passage of water into the operating electrical compartment while permitting the unrestricted broadcast of audible notifications.

In accordance with one embodiment of the present invention, a weather-proof notification device includes an enclosure having an integrally formed grille and an interior horizontal protrusion, and a speaker housed within and attached to the enclosure proximate the grille. The grille includes a plurality of downwardly-angled louvers to inhibit the entry of rainwater into the enclosure. In embodiments, the louvers further include upwardly-extending lips as an additional barrier to the intrusion of water.

To address water that may overtop the louvers and lips, the speaker and enclosure are configured to form a weather-proof sound chamber. A water-resistant or water-tight seal is provided between the speaker and the enclosure, and a water-repellent diaphragm is used in the speaker. More particularly, the seal may be provided between the speaker and the horizontal protrusion. A drain is formed in the grille to prevent the collection of water within the sound chamber.

In accordance with another embodiment of the present invention, an integrally-formed weather-proof enclosure for a notification device includes a grille having a plurality of louvers configured to inhibit the passage of water into the enclosure and at least one drain located to permit the free drainage of water from within the enclosure. The louvers are downwardly-angled to promote the flow of water from the interior, and include upwardly-extending lips as a further barrier. The enclosure is configured to provide a weather-proof seal between itself and the notification device, such as a speaker, housed therein. The enclosure may also include an optical notification device.

In accordance with yet another aspect of the present invention, a method of protecting a notification device from rain water is provided. The method includes providing a speaker with a water-repellent diaphragm, forming an enclosure with an integrally-formed grille configured to inhibit the passage of rainwater, and mounting the speaker to the enclosure such that a weather-proof seal is formed between the enclosure and the speaker. A drain is also provided in the grille to permit free drainage of water from within the enclosure.

In still another embodiment of the present invention, a notification device includes a weather-proof enclosure having an integrally formed grille configured to inhibit the entry of water there into and to permit free drainage of water there out of and a speaker attached to the enclosure. The speaker and the enclosure define a water-resistant sound chamber.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
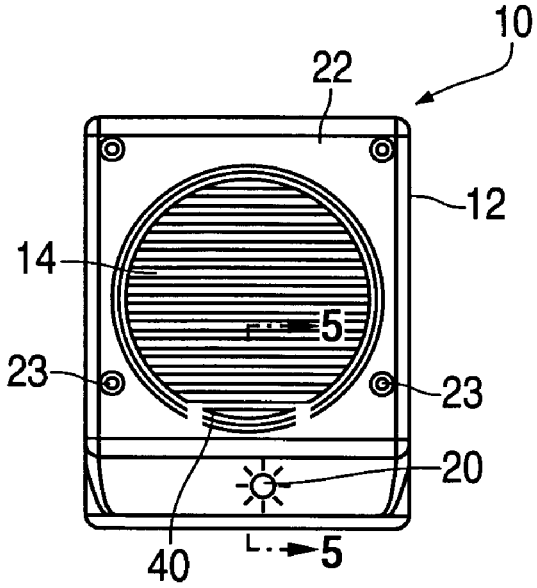
FIG. 1 is a front plan view illustrating a notification device according to a preferred embodiment of the invention.

The invention will now be described with reference to the drawing figures, in which like reference numerals refer to like parts throughout. An embodiment in accordance with the present invention provides weather-proof notification device including an enclosure and a speaker located within the enclosure. The enclosure has an integrally formed grille configured to inhibit the entry of rainwater into the enclosure. In embodiments, the grille includes several downwardly-angled louvers having upwardly-projecting lips at their rear edges. The speaker is attached to the enclosure proximate the grille, the speaker and enclosure defining a sound chamber. To prevent seepage of water from the sound chamber into the operating electrical compartment, the speaker utilizes a water-repellent diaphragm, and a water-resistant or water-tight seal is provided between the speaker and the enclosure. A drain is provided at the bottom of the grille to permit water to drain from the sound chamber. Thus, the present invention inhibits water from interfering with the operation of the notification device, but does not impede the broadcast of audible notifications.

Figure 2:
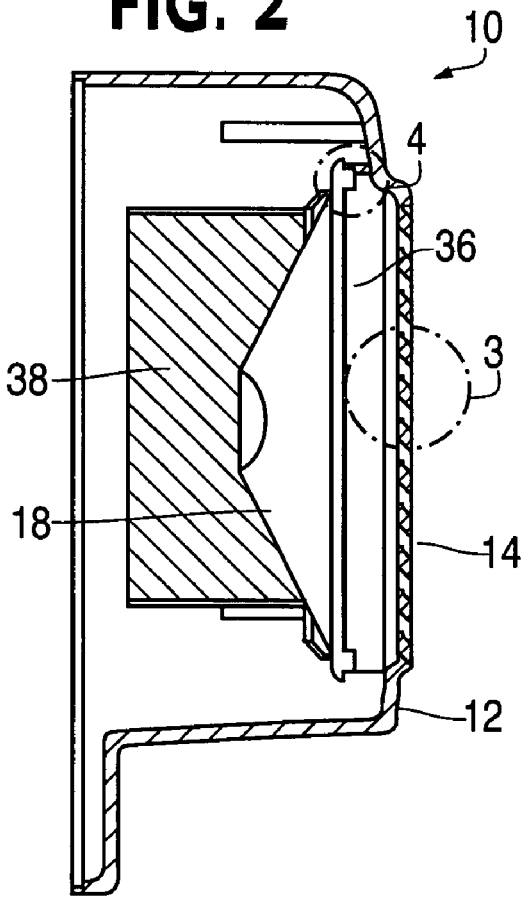
FIG. 2 is a cross-sectional side view of the device depicted in FIG. 1.

An embodiment of the present inventive apparatus is illustrated in FIGS. 1 and 2. A notification device 10 generally includes a weather-proof enclosure 12 having a grille 14, an interior horizontal protrusion 16, and a speaker 18. For purposes of the following description, the terms "weather-proof," "water-proof, " "rain-proof," and the like refer to compliance with the NEMA-3R standard for weather-proof equipment. However, it is noted that this is used for illustrative purposes in describing the preferred embodiment; the present invention is not limited to this particular standard.

Grille 14 is integrally formed with enclosure 12 in a single piece, for example by molding grille 14 and enclosure 12 from a single piece of plastic. Speaker 18 is located within and attached to enclosure 12 proximate grille 14. Accordingly, sound waves emitted by speaker 18 can easily pass through grille 14, where they may be heard by those in the surrounding environment. Attachment between speaker 18 and enclosure 12 may be provided by any means now known or hereafter discovered, including screws, bolts, and pins.

In embodiments, an optical signal 20, such as a strobe light, is provided on a face 22 of enclosure 12 as an additional means of providing notification to those in the surrounding environment. Optical signal 20 may be electrically connected to a controller for activation and deactivation. Mounting means, such as screw fasteners and corresponding holes 23 through enclosure 12, may be used to mount device 10 onto a mounting surface such as an exterior building wall.

Figure 3:
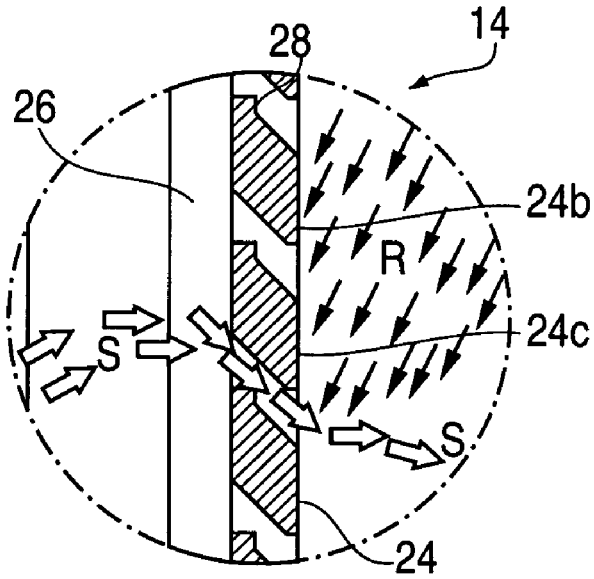
FIG. 3 is an enlarged view of detail 3 in FIG. 2.

Grille 14 is configured to inhibit the entry of rain water (vectors "R") into device 10. As illustrated in FIG. 3, embodiments of the present invention include a plurality of fixed, downwardly-angled louvers 24. Louvers 24 are integrally formed as part of grille 14, which, as described above, is an integral part of enclosure 12. In general, rain water impinging upon device 10 will drain, via gravity, along louvers 24, and away from the interior 26 of enclosure 12. In the event that device 10 is subjected to a driving rain (that is, a rain with a substantial horizontal component to vectors "R"), some rain water may be able to surmount louvers 24. Accordingly, upwardly protruding lips 28 are provided as a further barrier to inhibit rain water from entering interior 26 of enclosure 12. In embodiments, lip 28 extend upwards from a first louver 24*a* to a height generally parallel with a next higher louver 24*b* such that even a perfectly horizontal rain will encounter either a louver 24 or a lip 28. That is, louvers 24 and lips 28 are arranged so as to eliminate any straight path into the interior 26 of enclosure 12. Louvers 24 and lips 28 do not, however, interfere with the passage of sound waves "S" out of device 10, which continue to pass freely through grille 14 into surrounding environs.

Figure 4:
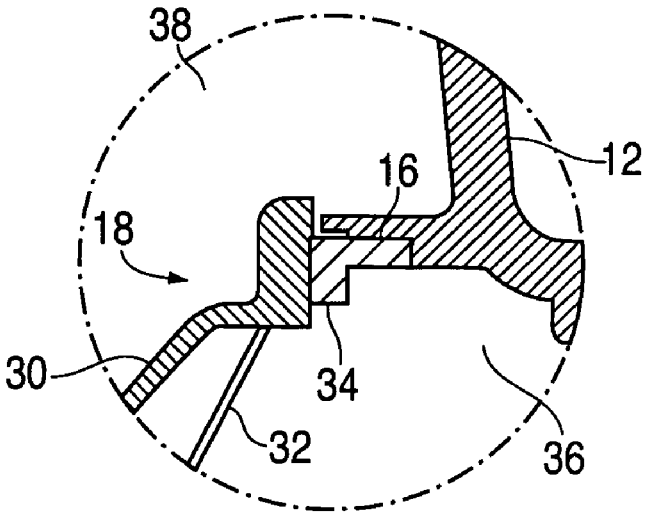
FIG. 4 is an enlarged view of detail 4 in FIG. 2.
Figure 5:
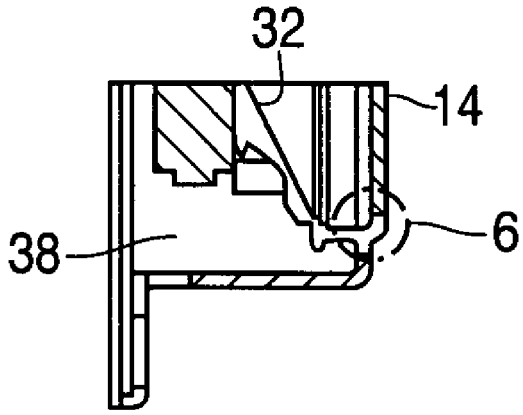
FIG. 5 is a sectional view along line 5-5 in FIG. 1.

Turning now to FIGS. 4 and 5, speaker 18 generally includes a speaker housing 30, a diaphragm 32, and a gasket 34. Gasket 34 surrounds the circumference of diaphragm 32, and serves to provide a weather-proof seal between speaker 18 and enclosure 12. In embodiments of the present invention, this seal is provided between speaker 18 and horizontal protrusion 16, though it is within the scope of the present invention to seal speaker 18 directly to enclosure 12. As described above, speaker 18 is attached to enclosure 12. The fasteners used to secure speaker 18 to enclosure 12 apply pressure to speaker 18, thereby mating gasket 34 to enclosure 12. Speaker 18 and enclosure 12, and in particular horizontal protrusion 16 and diaphragm 32, define a sound chamber 36.

In certain situations, rainwater may overtop lips 28 and enter sound chamber 36. From sound chamber 36, water might seep through the seal between speaker 18 and enclosure 26, or through diaphragm 32, and into operating electrical compartment 38. Thus, it is desirable for sound chamber 36 to be water resistant, and, in embodiments, water tight, in order that any water intruding into sound chamber 36 not be permitted to pass into operating electrical compartment 38 where it could harm electrical components of device 10. Accordingly, diaphragm 32 may be water repellent. Similarly, gasket 34 provides a seal between speaker 18 and enclosure 12 that is water resistant, and, in embodiments, water tight, to prevent leakage of water past gasket 34 and into operating electrical compartment 38. Thus, any water that passes into sound chamber 36 through grille 14 will, as an initial matter, remain substantially trapped therein rather than migrating into electrical compartment 38.

Figure 6:
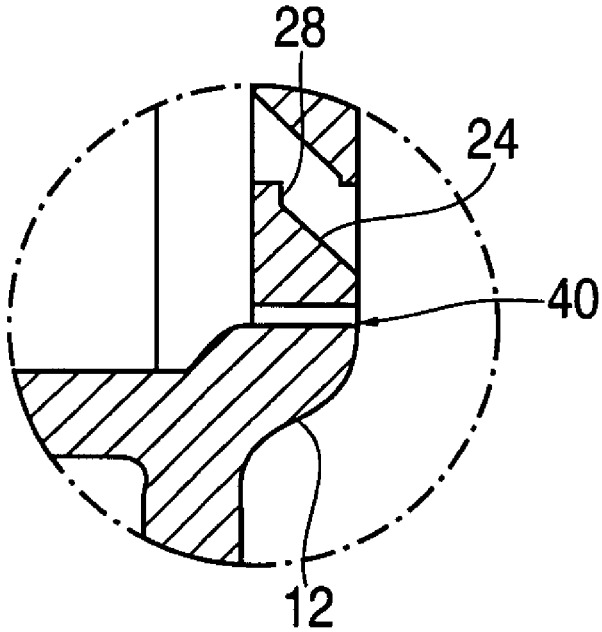
FIG. 6 is an enlarged view of detail 6 in FIG. 5.

Water retained within sound chamber 36 may interfere with the proper operation of speaker 18, for example by muffling the sound produced. Thus, it is desirable to provide an escape for any water that overtops lips 28 and collects within sound chamber 36. To this end, at least one drain 40 is provided in enclosure 12. In embodiments, as illustrated in FIG. 6, drain 40 is located at the base of and molded into grille 14. Drain 40 allows any water that has entered sound chamber 36 to freely drain therefrom.

In use, the present invention provides multiple layers of defense against the intrusion of water into notification device 10. Notification device 10 is installed, for example on an outdoor building wall without overhead cover. In a moderate rainfall, louvers 34 and lips 28 will function as described above to block and channel water away from the interior 26 of enclosure 12. In more severe rainfall, or in a driving rain, louvers 34 and lips 28 may be overtopped. Water that penetrates into interior 26 of enclosure 12 will initially be trapped within sound chamber 36 by water-repellent diaphragm 32 and the seal between speaker 18 and enclosure 12 provided by gasket 34, and will drain out via drain 40.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An enclosure for a notification device, the enclosure comprising:

a grille having a plurality of louvers configured to inhibit the passage of water into said enclosure; and at least one drain located to permit drainage of water from within said enclosure, wherein said enclosure comprises an integrally formed part, and wherein each of the plurality of louvers consists of:

a first end located adjacent an interior of the enclosure;

a second end located adjacent an exterior of the enclosure; and a lip located adjacent the first end, wherein the lip protrudes from the first end into a space between adjacent louvers.

2. The enclosure of claim 1, further comprising:

a speaker housed within an interior of the enclosure; and a protrusion adapted to provide a weather-proof seal between said enclosure and said speaker.

3. The enclosure of claim 2, wherein said speaker includes a water-repellent diaphragm.

4. The enclosure of claim 2, wherein said seal is water-resistant.

5. The enclosure of claim 2, wherein said seal is water-tight.

6. The enclosure of claim 1, further comprising:

an optical signal attached to said enclosure.

7. The enclosure of claim 1, wherein said drain is located at a base of said grille.

* * * * *

UNITED STATES PATENT AND TRADEMARK OFFICE

CERTIFICATE OF CORRECTION

PATENT NO. : 7,840,021 B2
APPLICATION NO. : 11/349163
DATED : November 23, 2010
INVENTOR(S) : Scott J. Greco and Walter R. Wrobel It is certified that error appears in the above-identified patent and that said Letters Patent is hereby corrected as shown below:

Title Page, item (73), should read;

Assignee information should read as follows: UTC Fire & Security Americas Corporation, Inc.

Signed and Sealed this
Thirty-first Day of May, 2011

David J. Kappos

David J. Kappos
*Director of the United States Patent and Trademark Office*